US006936792B2

(12) United States Patent
Jones

(10) Patent No.: US 6,936,792 B2
(45) Date of Patent: Aug. 30, 2005

(54) FURNACE CART AND LOAD TRANSFER SYSTEM FOR HIGH TEMPERATURE VACUUM FURNACES AND PROCESS THEREFOR

(76) Inventor: William R. Jones, P.O. Box 205, Telford, PA (US) 18969

( * ) Notice: Subject to any disclaimer, the term of this patent is extended or adjusted under 35 U.S.C. 154(b) by 281 days.

(21) Appl. No.: 10/153,296

(22) Filed: May 22, 2002

(65) Prior Publication Data

US 2003/0217999 A1 Nov. 27, 2003

(51) Int. Cl.[7] ..... F27B 5/14

(52) U.S. Cl. ..... 219/390; 219/405; 219/411; 392/416; 392/418; 148/113; 148/112; 148/580; 266/106; 373/112; 373/135

(58) Field of Search ..... 219/390, 405, 219/411; 392/416, 418; 198/113, 112, 580; 266/106; 373/112, 135

(56) References Cited

U.S. PATENT DOCUMENTS 3,971,679 A * 7/1976 Burger et al. ..... 148/113

* cited by examiner

*Primary Examiner*—Shawntina Fuqua

(57) ABSTRACT

Furnace cart assembly for loading high temperature vacuum furnaces for treating target material, for example, metal parts, under extreme temperature and vacuum environments. The furnace cart includes electrical heating elements as an integral part of the cart, which elements are adapted for releasable connection to the furnace electrical supply. When so connected the furnace cart heating elements can form a part of the heating system of the furnace. The lower part of the furnace cart assembly, including a frame above and supported on wheels, the frame having heat reflection means on at least Its upper surfaces providing some protection from heat is preferably also protected from heat during furnace operation by insulating material above the frame (the material desirably supported by the frame but separated therefrom).

18 Claims, 17 Drawing Sheets

FURNACE CART AND LOAD TRANSFER SYSTEM FOR HIGH TEMPERATURE VACUUM FURNACES AND PROCESS THEREFOR

FIELD OF THE INVENTION

This invention relates to heat treating furnaces that employ electric resistance heating elements, and in particular, to equipment, methods and systems for use with and for transferring target material into and out of such furnaces.

BACKGROUND OF THE INVENTION

Vacuum heat treating furnaces which employ electrical resistance heating elements are well known. A typical vacuum furnace has a furnace wall and a hot zone chamber of a circular cross-section which houses a series of banks of axial-spaced electrical resistance heating elements suspended from an inner wall of the hot zone chamber by a series of support rods. A heating element is generally made from graphite or molybdenum or a metal alloy, and generates radiant heat in response to electrical current passing therethrough. Popular designs are presented in U.S. Pat. No. 4,559,631 and in U.S. Pat. No. 4,259,538 (hereafter "the 538 patent"). The heat treating industry has benefited from reduced cost resulting from increased efficiencies in furnace performance resulting from inventions such as those described in: U.S. Pat. No. 6,021,155, "Heat Treating Furnace Having Improved Hot Zone" (hereafter "the 155 patent"), U.S. Pat. No. 6,023,487, "Process for Repairing Heat Treating Furnaces and Heating Elements Therefor" (hereafter "the 487 patent"), and U.S. Pat. No. 6,111,908, "High Temperature Vacuum Heater Supporting Mechanism with Cup Shaped Shield" (hereafter "the 908 patent"). Reduced cost has been a factor in creating larger demand for heat treating services. The services for "heat treatment" and "heat treating" as used in herein, unless otherwise specifically stated, refers to heat treatment under high vacuum, which includes both heating in the presence of selected gaseous environments, as well as high vacuum heating for brazing runs. Even though demand for heat treatment is high, competitive forces still require ever-increasing efficiencies. Larger furnaces have helped in response to that requirement. However, traditional mechanisms for loading target material pieces onto an internal furnace hearth become cumbersome, timely and/or potentially dangerous when used for loads having very heavy pieces. ("Target material" as referred to herein is the metal, ceramic or other material that is to be heat treated.) For example, even with specially designed fork lifts, loading the furnace is impractical with very heavy objects, e.g., target material pieces weighing 15,000 pounds. Currently employed lifts also create hazards to furnace elements (and other protrusions from the furnace inner wall) in loading and unloading large or heavy target materials that leave less room for vertical and/or horizontal tolerance. In addition to the above-described demand for treating larger target material pieces, I have found that there is a latent increased demand for treating larger loads (total size and/or weight). Existing furnaces rarely have a hot zone longer than 12 feet. Hence, it would be desirable to have a system that can safely load large or heavy target material into high temperature vacuum furnaces. It would also be desirable to provide a system for loading such material without major risk to furnace internal components. Because planarity of the furnace hearth is very important in many heat treating applications, it would also be desirable to provide a system that is robust and structured to accommodate precise hearth planarity.

One major limitation in designing a system to meet the above requirements has been difficulties associated with the apparent requirement of including any moving parts in the furnace hot zone. However, the extreme environments to which all parts are subjected in the hot zone (in access of 2000 degrees Fahrenheit, and very deep vacuum, e.g., up to $10^{-5}$ Torr) would cause lubricant evaporation and galling. Using "sealed" bearings cause their own problems (the bearing chamber may explode) under such drastic conditions.

The present invention describes a system for loading and unloading high temperature furnaces which is safe, productive and non destructive. The system also can handle heavy loads (for example, a total load of as much as 50,000 pounds). The new system can also load bulky materials while moving them in close proximity to internal protrusions, e.g., heating elements, (for example, a few inches) without concern for damage to the furnace. In another embodiment this invention provides the opportunity to minimize intrusion on valuable furnace time by minimizing time the furnace has to be open for the loading and unloading process. In yet another embodiment this invention provides a large robust hearth with an under-girding structure that supports high hearth planarity even when cycled through very high temperatures required for heat treating.

A BRIEF DESCRIPTION OF THE DRAWINGS

The objects and features of the present invention will be better understood from the following description taken in conjunction with the drawings which illustrate some preferred embodiments of the invention, as well as other information pertinent to the disclosure wherein.

A DETAILED DESCRIPTION OF THE INVENTION

Figure 1:
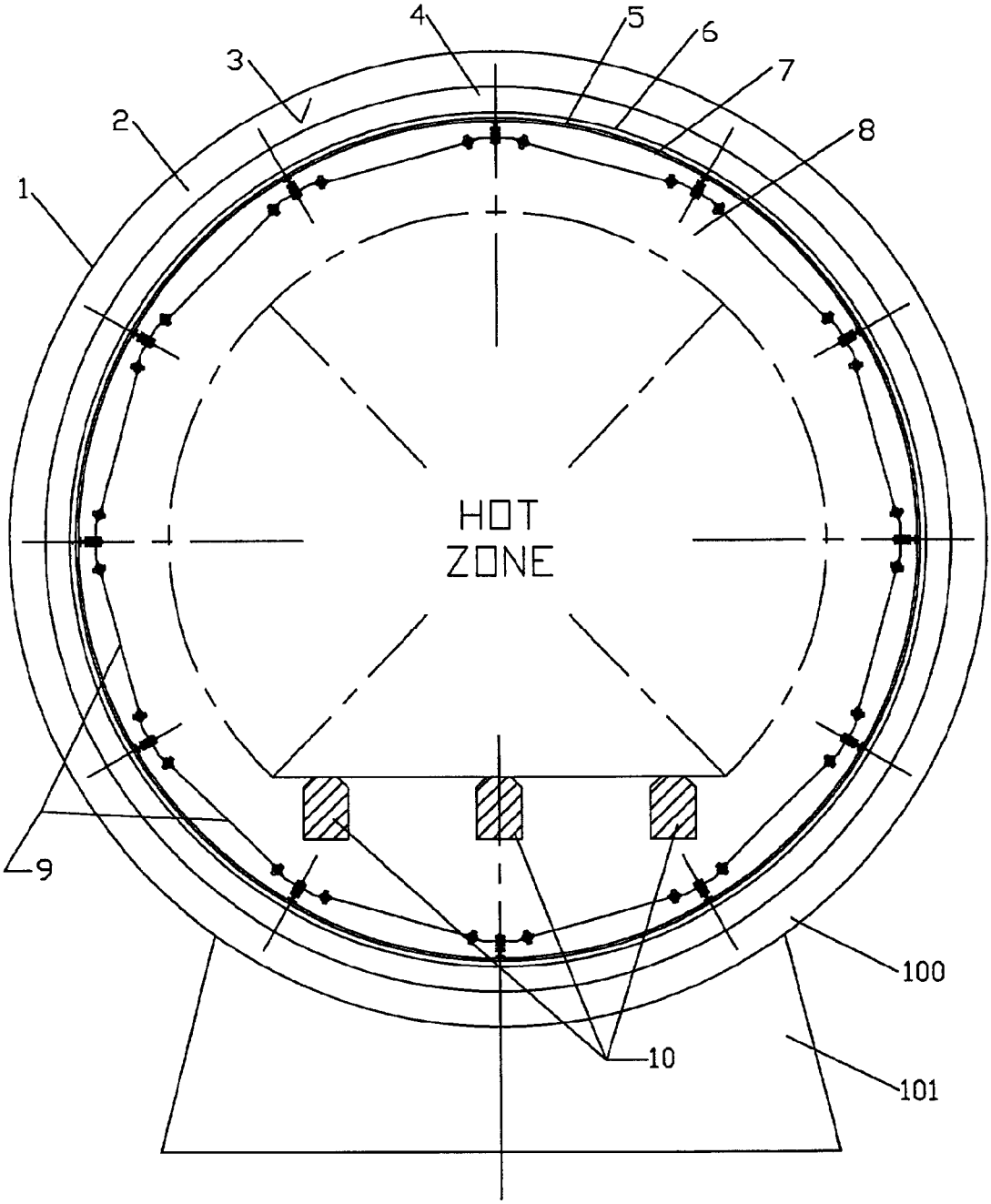
FIG. 1 depicts in perspective a prior art cylindrical cross section furnace that employs electric resistance heating elements.

Conventional high temperature vacuum furnaces have been described in numerous prior art patents. (See, for example, the 155 patent mentioned above.) In general, such furnaces are commonly formed in a substantially cylindrical shape having a substantially circular internal cross-section. Such a furnace is closed at its forward end by a releasable door, regularly with hinges so that the door swings out of the way for loading and unloading the furnace. The furnace doors have vacuum seals when closed to support the vacuum capability of the furnace. Also they regularly have insulation placed and formed to mate with insulation lining of the circular cross section furnace walls. As shown in FIG. 1, such furnaces routinely comprise a series of chambers, e.g., chambers 2, 4 and 8, formed between a series of large concentric cylinders supported by furnace support 101. The outermost chamber, coolant flow chamber 2 of furnace 100 has an outer wall 1 that defines the outer boundary of coolant flow chamber 2. Inner wall 3 of coolant flow chamber 2, thus, is also the outer wall of gas flow chamber 4. Inner wall 5 of gas flow chamber 4 is also the wall of hot zone chamber 8, the treatment chamber. On the inner surface of wall 5 of chamber 8 is secured heat shield 6 for containing radiant energy within the hot zone or other heat insulating means designed to impede heat transmission from hot zone chamber 8. The heat insulation means can contain a layer of KAOWOOL, a layer of graphite felt, and a sheet of reflective GRAFOIL. These are common insulating and reflective materials known by those in the vacuum furnace industry. One of ordinary skill in the art will readily recognize that although FIG. 1 and other drawings herein are not necessarily to scale, the drawings do illustrate the subject matter to which they are directed.

Because in many heat treating applications it is important to assure planarity of the furnace hearth, and because in some preferred embodiments of this invention it is important that the hearth support heavy hot zone chamber 8 comprises a plurality of banks of electric resistance heating elements 9. Heating elements 9 can be fabricated from graphite or other refractory material, but are often of relatively pure (commercially pure) molybdenum metal, and are typically rigid, elongated straight bars, having a rectangular cross section. Heating elements 9 are preferably oriented end-to-end with one another to form a series of ring-like banks spaced longitudinally within the hot zone chamber 8. These ring-like banks normally form a polygon (sometimes an incomplete polygon, as indicated below) of five to about twelve heating elements. Vacuum furnace 100 is mounted on at least two longitudinally spaced supports 101. Such a furnace includes about five to ten longitudinally spaced banks of heating elements 9, each bank being formed by 11 separate elements 9 as shown in FIG. 1. As also illustrated in FIG. 1 each heating element bank is not formed into a complete loop, but has two ends at which an electrical power source is connected. The polygons are connected to the inner wall of the hot zone chamber by a plurality of support rods (conventionally formed from relatively pure, commercially pure, molybdenum) that support each of the polygons a distance away from inner surface 7 of heat shield 6. Hot zone chamber 8 normally includes a series of firmly mounted and highly robust support bars 10, forming the furnace hearth.

The hot zone of such furnaces can operate within a temperature range of about 400 to 2500 degrees F., and optionally up to about 3000 degrees F. with a high degree of temperature uniformity and long product life. The hot zone in many furnaces has a work capacity at 2100 degrees F. of at least 1000 pounds with a heating element loop of at least 20–34 inches in diameter. The system is frequently designed to operate in conjunction with a roughing pump and a diffusion pump with the overall system capable of operating in a vacuum range of about $10^{-5}$ Torr.

Figure 2A:
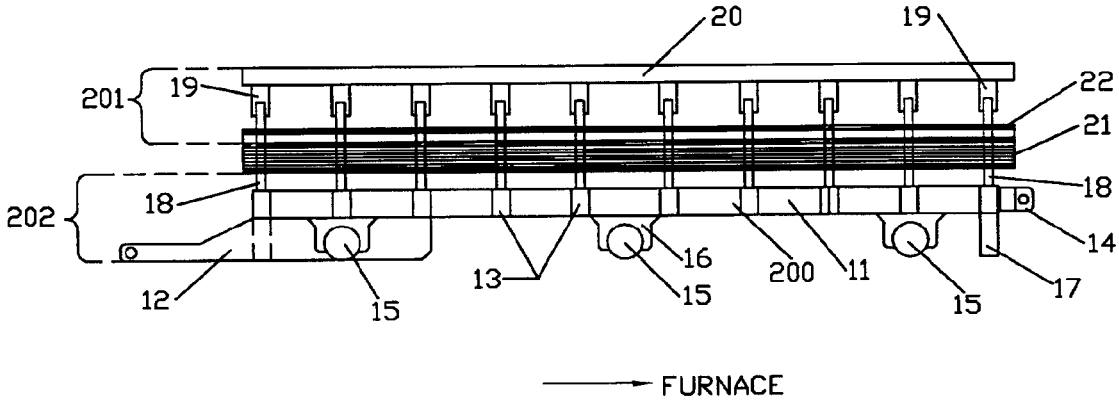
FIG. 2A depicts in a side plan view the furnace cart frame depicted in FIG. 2B but also including wheels and additional structural elements (some with exaggerated dimensions) embodied in a furnace cart according to one aspect of the present invention.
Figure 2B:
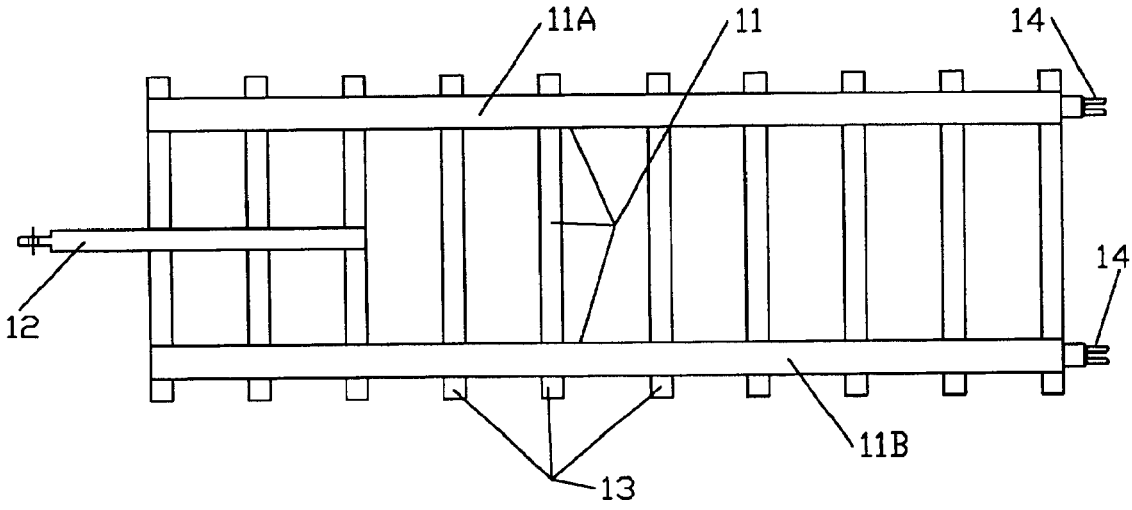
FIG. 2B depicts in top plan view a preferred furnace cart frame in accordance with one aspect of the present invention.

According to a preferred embodiment of this invention a furnace cart, which is mated to a specially designed furnace, is first loaded and then moved into such a furnace for heat treatment of the load. Such a cart, 200 is depicted in FIG. 2A in a side plan view wherein the cart comprises robust frame 11 as in FIG. 2B in which parallel segments of lateral structural tubing 13 are shown connected a right angles to longitudinal parallel segments. As illustrated in FIG. 2B, structural tubing segments 11*a* are spaced at regular spaced intervals along the length of parallel structural tubing segments 11*b*. On the rear of the frame is mounted tow bar 12 for connecting a powered transport mechanism to furnace cart 200. Wheel supports 16 and wheels 15 (which have special high temperature bearings) are mounted to frame 11 so that the wheels are below the frame and provide moveable support to cart 200. All of the structural materials in cart 200 ideally are chosen for stability when subjected to the environmental extremes required for heat treating. However, as indicated above, it is impractical to obtain bearings for wheels 15 that will stand up under such extremes. Even "high temperature" bearings do not stand up well under temperatures exceeding 600 degrees F. The protection of these bearings from the extreme temperatures and vacuum used in heat treating will be discussed below in detail in reference to a preferred embodiment of this invention depicted in FIG. 6. Optional connector 14 provides the cart with capability for connection to a second cart in accordance with another preferred embodiment of this invention as illustrated in FIG. 3. Leg 17, also fixed to frame 11, is a support stop.

The upper surface area of frame 11 is preferably coated with a highly heat reflective surface material such as an appropriate highly polished stainless steel, or a highly heat reflective and heat resistant paint. In some cases it is preferable to coat with such a highly heat reflective surface material all surfaces of frame 11 except the frame bottom.

As shown in FIG. 2A mounted on the upper surface of frame 11 are posts 18, which are very strong circular cross section tubes, preferably molybdenum tubes, rigidly connected to frame 11 at spaced intervals along lateral rectangular cross section structural tubing 13 (shown in FIG. 2B). In another preferred embodiment the rigid connection is through a non-heat conducting connector as more clearly depicted in FIG. 6 (connector 88) and discussion thereof. At the top of posts 18 are laterally positioned hearth support beams 19, each having recesses in its bottom surface for securely receiving posts 18. The recesses are of a depth that will provide substantial beam-to-beam planarity of the top surfaces of beams 19. On the top surface of support beams 19 is mounted hearth 20, desirably a very robust grid [MORE INFO] the top surface of which has a high degree of planarity, preferably to within one-fourth inch across the entire surface area. In a particularly advantageous embodiment of the present invention, support beams 19 have grooves centrally located along the full length of their top surface. This groove would accommodate a ceramic tube that would be placed in the groove thus separating slightly hearth 20 from beams 19.

Also mounted on the upper surface of frame 11, are supports (see FIG. 6, insulation frame 25), preferably having very low heat conductivity, for supporting insulation layer 21. In a preferred embodiment insulation layer is preferably of multi-layer insulation construction having a high heat shielding capability when compared to that of a conventional heat treating furnace. Insulation layer 21 is supported in a spaced relationship from frame 11. The distance of the space for any given cart is uniform, but in different carts the distance of insulation layer 21 from frame 11 can vary depending, for example, on factors such as the effectiveness of the insulation, the size of the cart and temperatures to which separate parts of the cart are to be exposed. Preferably insulation layer 21 is at least 2.5 inches from frame 11, and desirably between 2.5 and 5 inches from frame 11.

In accordance with another preferred embodiment of the present invention heating elements 22 are supported by frame 11, but electrically disconnected from frame 11. Thus, in another preferred embodiment of this invention when cart 200 is used in a compatible furnace, upper portion 201 (the cart portion that is above insulation layer 21) of cart 200 becomes part of the furnace hot zone. (See FIG. 5.) By contrast, even while cart 200 is used with upper portion 201 at heating treatment temperatures in such a furnace, lower portion 202 of cart 200 has an ambient temperature very substantially below heating treatment temperatures. The temperature differential between portion 201 and portion 202 during heat treatment can exceed 1900 degrees F.

Figure 3A:
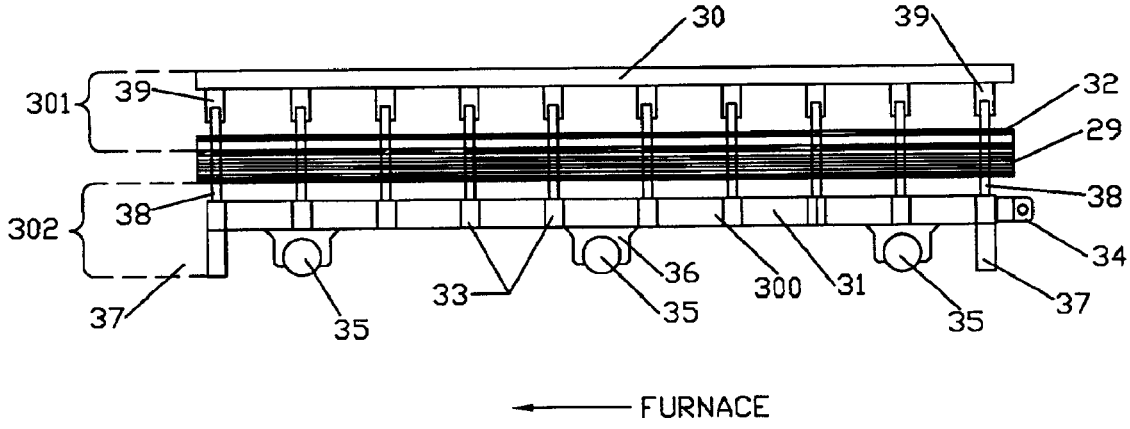
FIG. 3A depicts in a side plan view the furnace cart frame depicted in FIG. 3B but also including wheels and additional structural elements (some with exaggerated dimensions) embodied in a second furnace cart, this second furnace cart structured for mating with and movement with the furnace cart depicted in FIG. 2A in accordance with another aspect of the present invention.
Figure 9:
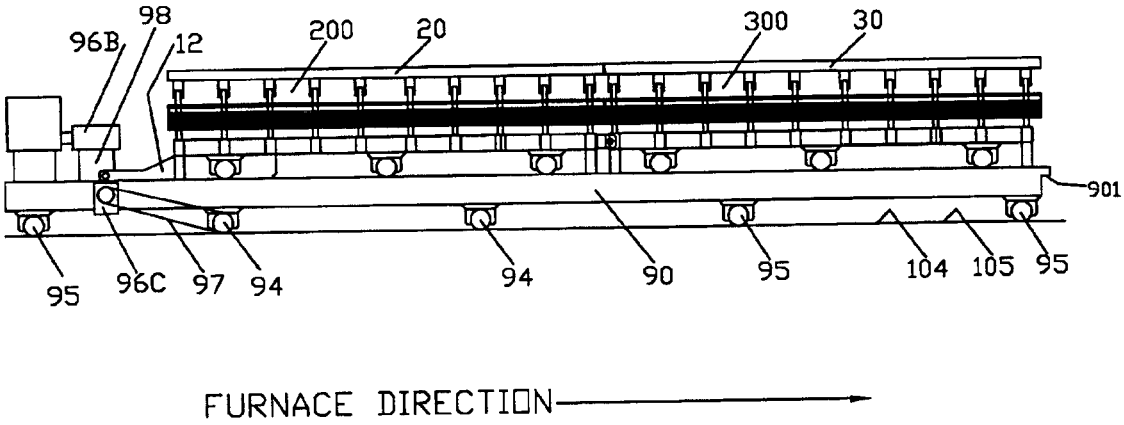
FIG. 9 depicts the furnace cart of FIG. 3A connected to the furnace cart of FIG. 2A with the connected carts in position on a transfer cart in accordance with a further aspect of the invention.

FIG. 3A depicts furnace cart 300 which, in another preferred embodiment of this invention, couples with and end mates with furnace cart 200 for use in a furnace with a longer hot zone, in this case effectively twice as long. The FURNACE direction arrows in FIG. 3A illustrates that for mating one or the other of carts 200 or 300 would need to be reversed in order to accomplish a coupling the carts. The coupling of the carts is illustrated and discussed more specifically with reference to FIG. 9, below.

Figure 3B:
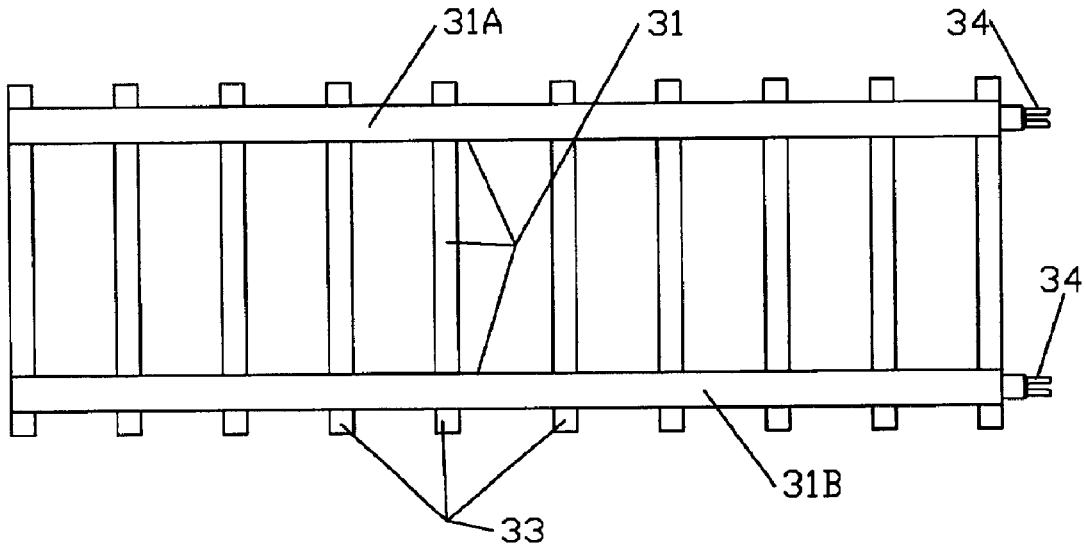
FIG. 3B, depicts in top plan view a second furnace cart frame which is structured for end to end mating with the furnace cart frame depicted in FIG. 2B.
Figure 13:
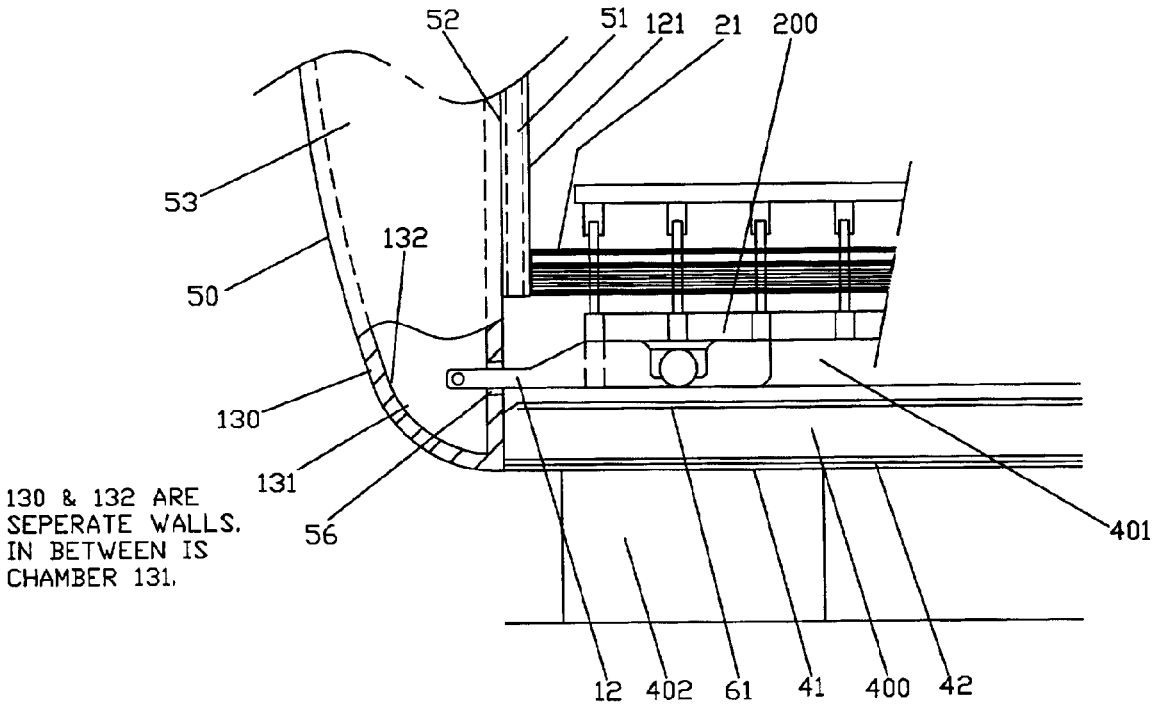
FIG. 13 depicts the furnace cart placement in the furnace with the furnace door closed.

The functions and structure of cart 300 of FIG. 3A and frame 31 of FIG. 3B are basically the same as those described above for corresponding parts referenced with respect to FIG. 2A and FIG. 2B. Thus, insulation layer 21 of FIG. 2A, corresponds to and is very similar to insulation layer 29 of FIG. 3. The differences between the structure of insulation layers 21 and 29 relate to the mating relationship of the carts with each other and with the furnace hot zone ends as will be described in more detail in reference to FIG. 9 below. Basically, the front (furnace direction) of furnace cart 200 mates with the rear of furnace cart 300, while the rear of cart 200 is designed to mate with the hot zone end (the inside of a closed door at the entrance of the furnace. (See FIG. 13.) In one aspect of this invention, in cart 300 there is no tow bar corresponding to tow bar 12 of FIG. 2B. In a preferred embodiment, the front of furnace cart 300 mates with the distal furnace hot zone end which is a door very similar to the entrance door of the furnace. The composition of insulation layer 21 is desirably identical to that of layer 29. Thus, although there are differences for mating relationships the compositions, structures and functions for frame 31 and structural tubing 31*a*, 31*b* and 33 of FIGS. 3A and 3B correspond to those of 11, 11*a*, 11*b* and 13, respectively, of FIGS. 2A and 2B; while heating elements 32 correspond to 22 of FIG. 2A, connectors 34 correspond to 14 of FIGS. 2A and 2B, wheels 35 correspond to 15 of FIG. 2A, wheel supports 36 correspond to 16 of FIG. 2A, legs 37 correspond to 17 of FIG. 2A, posts 38 correspond to 18 of FIG. 2A, hearth support beams 39 correspond to 19 of FIG. 2A, hearth 30 corresponds to 20 of FIG. 2A, and heating elements 32 correspond to 22 of FIG. 2A.

Figure 4:
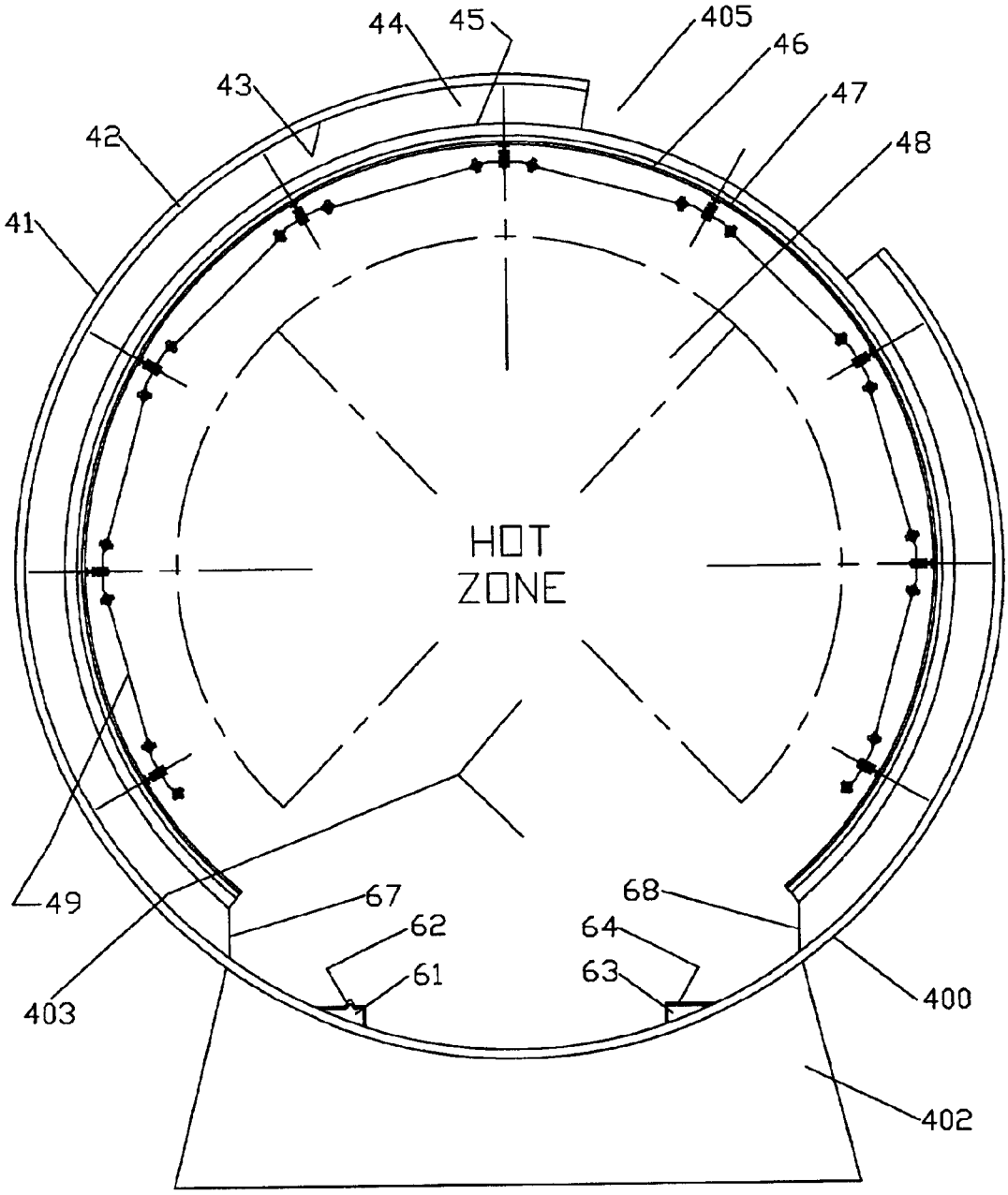
FIG. 4 depicts in perspective a front, open door cross sectional view (with some exaggerated dimensions) a semi-cylindrical electrical resistance heating high temperature high vacuum furnace for use with furnace carts depicted in FIGS. 2A and 3A, and capable of a loading and unloading fit with the transfer cart depicted in FIG. 9.

FIG. 4 depicts in lateral cross-section furnace 400 illustrating both similarities to and marked differences from prior art furnaces illustrated in FIG. 1. Furnace 400 is designed so that it mates with carts 200 and 300, but could be designed to accommodate a single cart. Furnace 400 in lateral cross section has concentric semicircular arcs defining walls of chambers serving similar functions to the circular cross section chambers of furnace 100. The exterior of furnace 400, like prior art furnaces, is substantially cylindrically shaped and, like prior art furnaces, is mounted above floor level. Furnace 400 also has a substantially circular external cross-section, mounted on furnace mount 402, with circular cross section liquid coolant chamber 42 having circular cross section outer wall 41 and inner wall 43. As shown in FIG. 4, furnace 400 further comprises additional chambers, gas flow chamber 44 and hot zone chamber 48, both having semicircular cross sections. FIG. 4 further illustrates port 405 interrupting walls 41 and 43. Port 405 extends only a short distance along the length (longitudinal direction) of walls 41 and 43 and provides the entry port for gas to enter and to be evacuated from gas flow chamber 44.

Hot zone chamber 48 is the upper part of vacuum chamber 403 of furnace 400. Part of inner wall 43 (desirably an arc of about 300 to 320 degrees) of coolant flow chamber 42, is also the outer wall of gas flow chamber 44. Semicircular cross section inner wall 45 of gas flow chamber 44 is also the wall of hot zone chamber 48. On the inner surface of wall 45 of chamber 48 is secured heat shield 46 for containing radiant energy within the hot zone or other heat insulating means designed to impede heat transmission from hot zone chamber 48. Heat shield 46 is desirably a multi layer, highly heat resistant porous graphite insulation, similar in composition and heat containment capability to insulation layer 21 of cart 200 (See FIG. 2A.)

Hot zone chamber 48 comprises a plurality of banks of electric resistance heating elements 49. Heating elements 49 can be fabricated from graphite or other refractory material, but are often of relatively pure (commercially pure) molybdenum metal, and are typically rigid, elongated straight bars, having a rectangular cross section. Heating elements 49 are mounted proximate to but spaced from inner surface 47 of heat shield 46, and preferably oriented end-to-end with one another to form a series of ring-like banks spaced longitudinally within the hot zone chamber 48. As described above, in conventional furnaces these ring-like banks normally form a polygon or near polygon five to about twelve heating elements. In vacuum furnace 400 there could be (depending on the length of the hot zone) 10 to 30 longitudinally spaced banks of heating elements 49, desirably 28 banks in a 24-foot hot zone. Each bank is formed by 10 separate elements 49 as shown in FIG. 4, but the number of elements 49 in each bank could vary from five to 15. As illustrated in FIG. 4 each heating element bank is not formed into a complete polygon or near polygon. Rather, each bank has a significant opening generally where hot zone chamber 48 would accommodate loaded furnace cart 200 and/or 300 entry into furnace vacuum chamber 403 for treatment of material on the cart. Hence the each bank has two ends in radial proximity to furnace heat shield edge joints 65 and 66. The semicircular portion of furnace 400 hot zone desirably would have an arc of about 260 to 280 degrees clockwise from insulation edge 65 to insulation edge joint 66. Carts 200 and 300 (FIGS. 2A and 3A) are designed to have horizontal heating elements 22 and 32, respectively, constitute the bottom heating elements of furnace 400's hot zone.

Gas flow chamber 44 is also semi-cylindrical. Support walls 67 and 68 of chamber 44 are longitudinally sealed to walls 43 and 45 of chamber 44 thereby forming lower part 401 of vacuum chamber 403. Lower part 401 accommodates loaded furnace cart entry (See FIG. 5A) into vacuum chamber 403 for treatment of material on the cart. Tracks 61 and 63 also accommodate movement of furnace carts 200 and 300 into and out of furnace 400. Guide 62 on track 61 mates with a mating groove on the peripheral surface of mating side cart wheels to guide the carts precisely along a longitudinal path in the furnace. Further description of tracks 61 and 63 and their functions are set forth in reference to FIG. 5A below. The length of the furnace hot zone would generally determine the length of cart(s) needed for efficient use of furnace space. Existing prior art furnaces are generally no longer than 12 feet in length. To get incremental volume efficiencies out of a redesigned furnace, a significantly larger furnace is advantageous. Nonetheless, it will be recognized that many of the advantages of systems and carts described herein could be gained by using such carts mated for use with furnaces sized more conventionally. In a preferred embodiment of this invention Carts 200 and 300 are each desirably 10 to 14 feet in length at their longest point (excluding tow bar projection beyond the frame length) again depending on the length of the furnace hot zone. In an especially preferred embodiment carts 200 and 300 are between 11 feet and 12.5 feet in length (also excluding tow bar projection) to mate with a furnace having a hot zone length of approximately 22 to 25 feet. In another especially preferred embodiment the carts have a coupled length of about 24 feet to mate with a furnace having a 24-foot long hot zone.

Figure 5A:
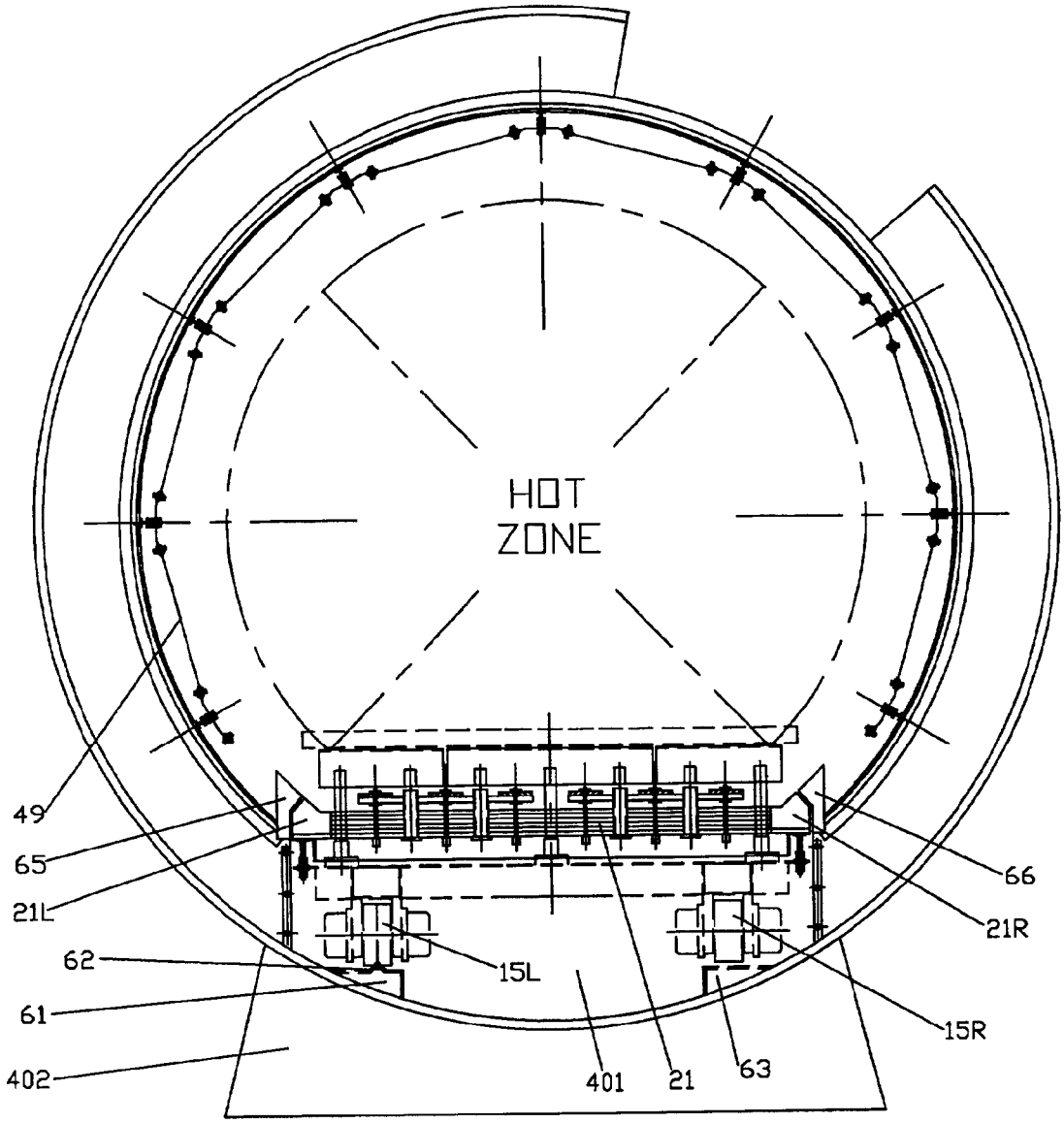
FIG. 5A depicts in perspective and partial front plan view the furnace cart of FIG. 2A in position in the furnace of FIG. 4.
Figure 5B:
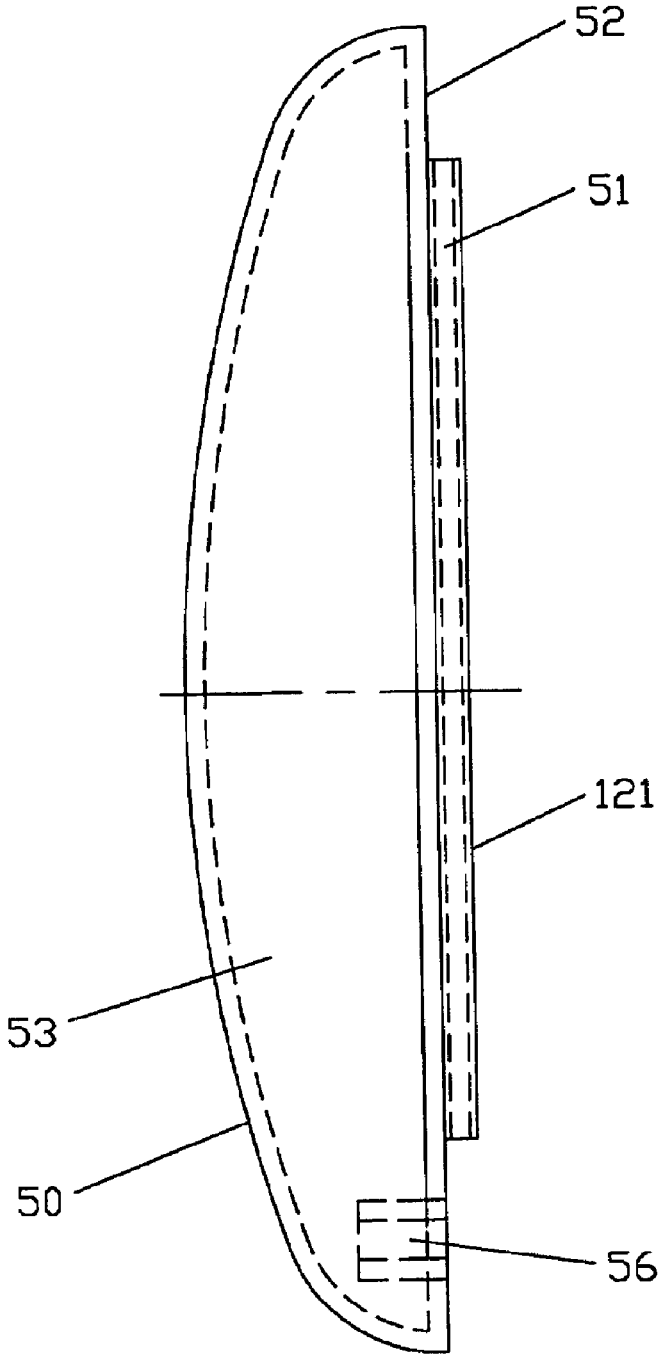
FIG. 5B depicts in cross sectional side view a door for the furnace of FIG. 4.

Cart width can vary depending on the width of the furnace hot zone and the design of the furnace. For a circular cross section furnace cart width also would depend to some extent on the height of target material intended for treatment. For example, for a furnace having a semicircular diameter of twelve feet the width of the hearth would preferably four to eight feet wide. The width (lateral) of the cart opening for the furnace cart can also vary widely, to meet furnace design. In accordance with an especially preferred embodiment of this invention, FIG. 5A depicts in lateral cross section furnace 400 with carts 200 and 300 in furnace 400. Because the structure and functions of carts 200 and 300 are so similar, references in FIG. 5A describing cart 200 generally can apply also to cart 300. Differences in structure to accommodate coupling and furnace ends will be described more completely in FIG. 9, below. For a number of reasons, many of them having to do with operating, cooling and maintenance, prior art furnaces have a swinging door at the furnace entry, the inside of which has insulation that would mate with furnace wall insulation for providing an insulated vacuum tight end to the furnace. The door to furnace 400 is illustrated in FIG. 5B wherein furnace door 50 is illustrated in cross section cut-away. Hinges 55 (FIG. 5C) are mounted on door 50 and furnace 400 in a conventional manner for stable support for swinging heavy metal door 50 to open or closed positions. According to one embodiment of this invention, tow bar 12 is long enough so that when cart 200 is in its ideal location for heat treatment of material thereon, the connecting end of tow bar 12 protrudes from the furnace opening into door inner chamber 53. This allows push-pull tug 98 (FIG. 10) to connect/disconnect outside the open door furnace 400. Port 56 in door 50 accommodates the end of tow bar 12 (FIG. 2A) when cart 200 is in place in furnace 400 and door 50 is closed. (See FIG. 13.)

Figure 5C:
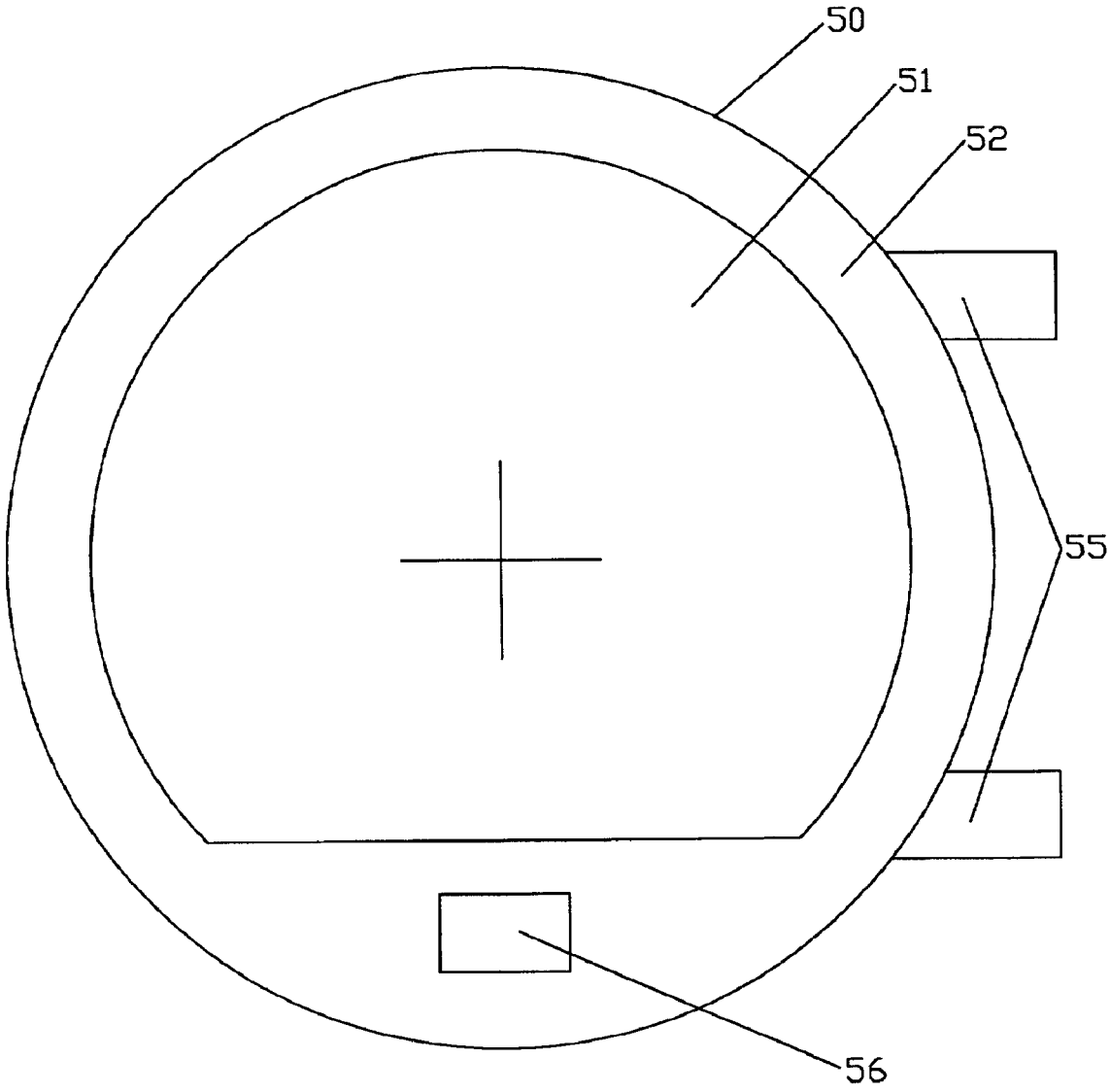
FIG. 5C depicts in front plan view the door of FIG. 5B.

As shown in FIG. 5C, which depicts a view of the inner side of open door 50, inside surface 52 of door 50 is partially covered with insulation covering 51 having inside surface 121. When cart 200 is in place in the furnace and furnace door 50 is closed, the semi-circular profile of insulation covering 51 will mate with heat shield 46 (FIG. 4) and insulation layer 21 (FIG. 5A). The inside surface of the opposing end of furnace 400 also is covered with heat shield/insulation to the extent necessary fo form the hot zone. Thus, closed furnace 400 with cart(s) in place would have a hot zone substantially completely protected by insulation/heat shield. In some circumstances it is desirable to have a door similar to door 50 also at the opposing end of furnace 400. This offers additional opportunities for accessing ends of each of two carts that may be in the furnace simultaneously. The second door desirably would also have an inner surface having insulation thereon to mate with the first to enter longitudinal end of cart insulation layer and heat shield 46 to complete the hot zone insulation.

As indicated in the discussion of FIG. 4 above, cart 200 is moved into furnace 400 on tracks 61 and 63. Guide 62 of track 61 mates with the mating peripheral groove in wheel 15L (and similar grooves in other guide-side, track 61 side, wheels) and provides directional guidance to cart 200 as it moves into the furnace. Guide 62 of track 61 also keeps guide-side wheels 15L from moving laterally during the heat treating cycle. Flat surface 64 of track 63 provides stability to cart wheels 15R with flat peripheral surface traveling or resting thereon. However, the flat surface to flat surface mating accommodates lateral thermal expansion and contraction of carts during heating and cooling cycles in the lateral directions away from guide side wheels 15R. Insulation 21 of cart 200 is at a plane and shaped so that insulation width edges 21L and 21R of cart insulation 21 each come within a fraction of an inch of meeting furnace heat shield ends 65 and 66 respectively. Because of thermal expansion away from guide-side wheels 15L and in the direction of furnace heat shield edge joint 66 the fraction of an inch will ideally be sufficiently larger for the mating space between cart insulation edge 21R and furnace heat shield end 66 than would be required for the mating space between 21L and 65. The thermal expansion of cart insulation layer gives rise to a system advantage. When the cart is cool (room temperature or slightly above) the cart can be moved in and out of the furnace with no insulation edge to insulation end abrasion. Yet, while the furnace is hot, expanded cart insulation layer can more effectively separate hot zone chamber 48 (FIG. 4) from lower part 401 of vacuum chamber 403 and more effectively minimize opportunity for convective heat from furnace hot zone chamber 48 to reach lower furnace portion 401. As a result cart wheels 15L and 15R and their bearings 15B (See FIG. 6) are better protected from the extreme temperatures of furnace hot zone chamber 48.

Figure 6:
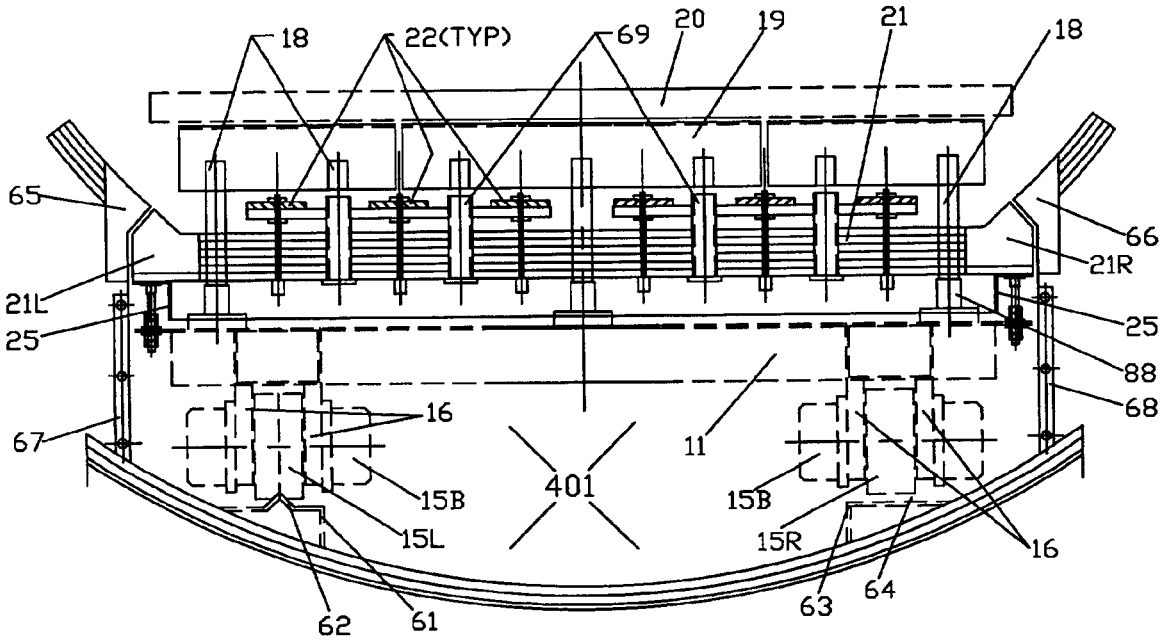
FIG. 6 depicts in expanded partial cross section the mating relationship of the furnace cart and furnace depicted in FIG. 5A and the structural and operational features of the furnace cart in accordance with additional aspects of the invention.

Additional details of the end view of cart 200 are depicted more clearly in FIG. 6 in partial cutaway cross section illustrating the fit of cart 200 in lower part 401 of vacuum chamber 403. Support walls 67 and 68 chamber form the side walls of chamber 401. Heat shield edge joints 65 and 66 meet with cart insulation layer shaped width ends 21L and 21R respectively. Guide side wheels 15L rest on track 61 having guide 62 while laterally opposed wheel 15R rests on flat track surface 64 of track 63. Wheel supports 16 connect wheels 15L and 15R (each having bearings 15B) respectively to frame 11. Mounted on frame 11 are angle frames 25 which support insulation layer 21 and heating elements 22. Whereas heating elements 49 (FIG. 4) are separate heating element semi-polygonal banks radially positioned along the length of furnace 100, heating elements 22 of cart 200 according to one preferred embodiment of this invention are a series of parallel linearly disposed element banks aligned with the length of the furnace. (FIG. 2A illustrates the linear positioning along the length, as does FIG. 8 discussed in detail below.) FIG. 6 illustrates in cutaway the cross section of the linear bank placement along the width of cart 200. FIG. 6 also illustrates preferred lateral positioning of posts 18, which support beams 19 on which rests hearth 20. In addition, according to another preferred embodiment of this invention, FIG. 6 illustrates the inclusion in cart 200 of quench tubes 69 made of very low heat conducting material, e.g., ceramic. Tubes 69 penetrate through the thick insulation barrier, but their very low heat conducting character minimizes the loss of insulation effectiveness during heat treatment. However, quench tubes 69 play a very important role in permitting quenching gas to flow through thereby assisting in rapid quenching of target material after heat treatment. Rapid quenching is essential for some target material. It is important for the inside diameters of quench tubes 69 to be sized large enough to accommodate quenching but not so large that the tubes permit substantial heat loss through them during the heating treatment step. I have determined that inside diameters of from 1 inch to 3 inches are particularly effective, with an especially preferred inside diameter being in the range or from 1½ to 2½ inches. The wall thickness of quench tubes 69 preferably should be in the range of from ⅛ to ¼ inch. It is also helpful to have quench tubes 69 long enough to penetrate insulation layer 21 and to protrude from the upper surface of insulation layer 21 sufficiently so that the top of each tube is at a level above the upper surface of heating elements 22 and 32 (FIG. 3A). Also advantageously mounted on frame 11 are non-heat conducting (desirably ceramic) connectors 88 providing stable connecting support to posts 18.

Figure 7:
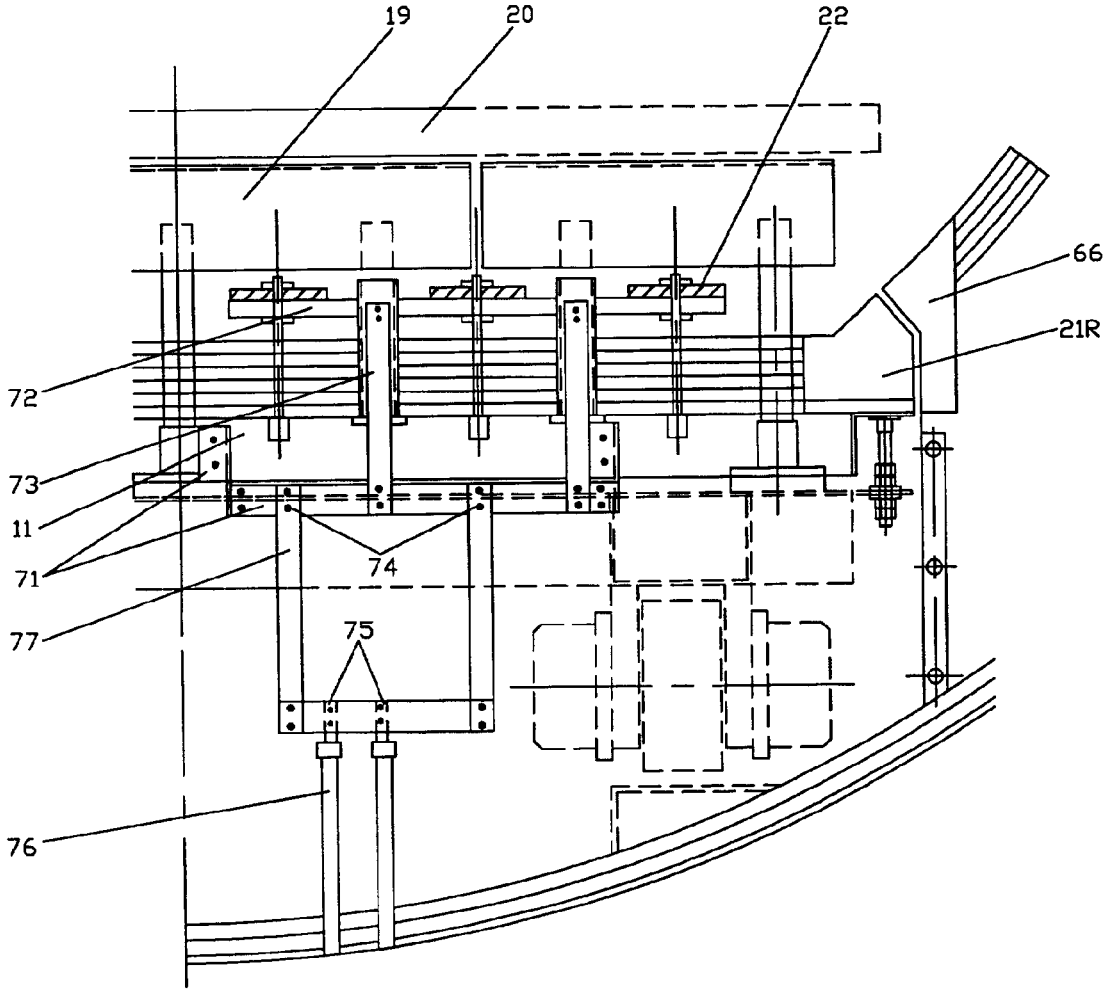
FIG. 7 depicts in partial plan view an electrical connection linking a furnace power source to the electrical resistance heating element system of the furnace cart depicted in FIG. 6 in accordance with another embodiment of the invention.

FIG. 7 zooms in on the non-guide side of cart 200 in a partial cutaway plan view illustrating a simple electrical connection means 77 for electrically connecting internal furnace power source 76 to connector bars 72 which are conductively connected to heating elements 22 of cart 200 to provide power so that heating elements 22 can operate as a complement to heating elements 49 (See FIG. 5A) in heating furnace hot zone chamber 48. Connection means 77, according to one preferred embodiment of the invention is a braided flexible connector which can be disconnected from cart 200 and/or from internal furnace power source 76 simply by removing bolts at connector locations 74 or 75. FIG. 7 also illustrates more clearly an advantageous mating relationship between insulation layer edge 21R and furnace heat shield edge joint 66.

Figure 8:
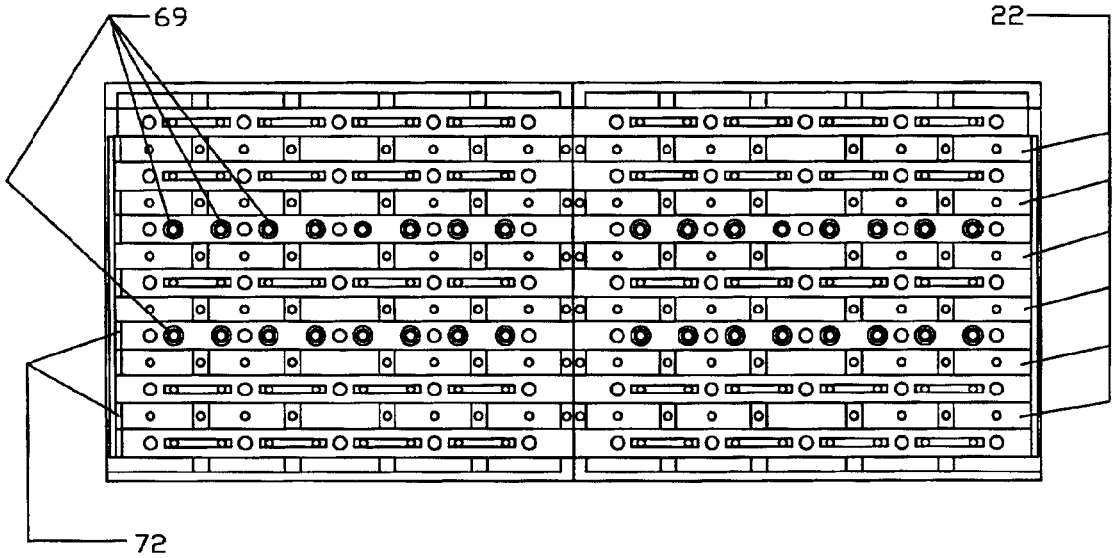
FIG. 8 depicts in top, layered cutaway the heating element system of a furnace cart as depicted in FIG. 6 and additional elements of the furnace cart structure.

Furnace cart 200 as shown in a partial top view cutaway in FIG. 8 illustrates the six banks of heating elements 22, as discussed above in reference to FIG. 6, are linearly disposed along the length of cart 200. When cart 200 is in place in furnace 400, the banks of heating elements 22 are linear along the length of furnace (longitudinal to the furnace). Each of the six banks is made up of a plurality of individual heating elements 22 joined end to end by heating element junction 24. In a preferred embodiment of this invention each element bank has 4 heating elements connected together end to end with heating element junctions 24. In another preferred embodiment heating elements 22 are graphite heating elements. Proximate the ends of each heating element bank is a connection (desirably refractory bolts) linking end heating elements to heating element interconnects 72. (See FIG. 7.) FIG. 8 further illustrates the lateral and longitudinal positioning of quench tubes 69 discussed more specifically in reference to FIG. 6, above.

In another important aspect of this invention there is provided a means for assuring furnace carts 200 and 300 are at the precise required entry level and location as they approach furnace 400 for entry. Consistent with prior art furnaces (See FIG. 1) as shown in FIG. 4 furnace 400 also has its entry point above floor level. In a preferred embodiment of the present invention the means for assuring furnace cart entry level and location comprises a transfer cart 90 (FIG. 9) that carries furnace carts to the furnace at the appropriate level and location for entry into the furnace. Although the connecting and loading sequence can vary, desirably furnace carts 200 and 300 would reside on transfer cart 90 before the furnace carts are moved into and after the carts are removed from furnace 400. Furnace carts would be loaded and unloaded while connected to each other through connectors 14 (FIG. 2A and FIG. 3A), and while connected to push-pull tug 98 by tug connector 106 and cart connector 12. After material to be treated, target material, is loaded unto furnace carts 200 and 300 transfer cart 90 is moved in the direction of furnace 400 entry. In another preferred embodiment of the invention transfer cart 90 moves on wheels 94 and 95, for example, powered by drive wheels 94 (94L and 94R, FIG. 10) which rotate in response to rotational power supply 96*c* driving chain 97 which in turn communicates with drive axel 93. Power supply 96*c* can be a separate motor, desirably electric, or can be power transfer, e.g., by using drive gears or chains communicating with power supply 96*c* from, for example, power supply 96*a*. Advantageously, the transfer cart wheels move on tracks 104 and 105 (FIG. 10), desirably with at least one of the tracks having an alignment guide mating with a groove in wheels corresponding wheels 94 and 95. (See, for example, FIG. 10 wherein wheel 94L mates with alignment guide 99 of track 104.) In one aspect of the invention all guide side wheels have similar mating grooves. On opposing sides of transfer cart upper support surface 960 are parallel tracks 961 and 963 which are separated from each other by the same distance as the distance that separates tracks 61 and 63 of furnace 400. On track 961 is alignment guide 962 which has a cross section profile substantially identical to the cross sectional profile of alignment guide 62 of track 61 (FIG. 6). Tracks 104 and 105 are positioned so that when transfer cart 90 gets to its furnace entry location, track 963 will align with track 63, and track 961 with alignment guide 962 will align with track 61 with alignment guide 62 of furnace 400 (FIG. 6). Cart support extension 901 projects into lower part 401 of vacuum chamber 403 of furnace 400 just far enough to permit end-to-end mating (within one-eighth inch) of track 961 with track 61 and track 963 with track 63. (See FIGS. 11 and 12.) Advantageously, by movement controlled with the chain drive (and, if necessary, screw drive adjusters) the distance transfer cart 90 moves in the direction of the furnace could be controlled very precisely, for example with computer controls.

Once the transfer cart is in place at the furnace entry its location is secured, for example, by appropriate brakes on wheels 94 and/or 95 and/or transfer cart movement chain 98, or a simple docking lock. Then furnace carts are moved from transfer cart 90 into furnace 400 by the pushing motion of push-pull tug 98 which is set in motion by power source 96*b* (FIG. 11), desirably with a chain drive, discussed in more detail below. Again the distance of movement, this time of furnace carts 200 and 300 into furnace 400, can be controlled very precisely using a separate chain drive, powered by the same or different power source. Of course, during normal operation carts 200 and 300 would carry loads of target material into the furnace on hearths 20 and 30. When furnace carts 200 and 300 are in place, tow bar 12 of cart 200 is disconnected from push-pull tug 98. Transfer cart 90 is then unsecured and moved on tracks 104 and 105 away from the furnace far enough to permit closing of the door to the entrance of furnace 400. (See FIG. 13, below.) Electrical connection of elements 22 and 32 is then assured, for example, using electrical connection means 77 (FIG. 7). For a furnace having doors at both ends such a connection can be used at each end, and the carts could be each electrically connected to different electrical supply modules located at opposing ends of furnace 400. The furnace door would then be closed (secured) and the treatment cycle begun. Target material would then be subjected to heat treatment (including heat, vacuum, quenching etc.). After the treatment is complete, and the hot zone and target material are at a suitably low temperature, the furnace door would be opened, and electrical disconnection to cart heating elements 22 and 32 would be assured. Then transfer cart 90 is again brought into secured mating position with furnace 400, and push-pull tug 98 is reconnected to tow bar 12 of cart 200. Push-pull tug 98 then pulls furnace carts 200 and 300 out of the furnace and onto transfer cart tracks 961 and 963. Transfer cart 90 is then released for movement on tracks 104 and 105 away from furnace 400. Although furnace carts 200 and 300 could be unloaded and reloaded without moving the carts away from the furnace, normal operation would involve movement of the carts away from the furnace to facilitate such things as furnace inspection, cleaning, and repair (if necessary), as well as providing assurance of adequate room for loading and unloading carts 200 and 300. For furnaces used for shorter cycle times where rapid furnace loading and unloading would be economically important, it may be desirable to use more than one set of transfer and furnace carts. This can be accommodated, for example using techniques that would permit a plurality of cart sets operating off a single furnace by using one or more turntable mechanisms. The carts with appropriate adaptation could also be moved out the second door (rear door) of furnaces with doors at the front (entry) of the furnace and at the rear. The floor would desirably have tracks at the furnace rear that would accommodate and guide a transfer cart that would be a mirror image of transfer cart 90 insofar as mating with furnace tracks and out moving furnace carts.

Figure 10:
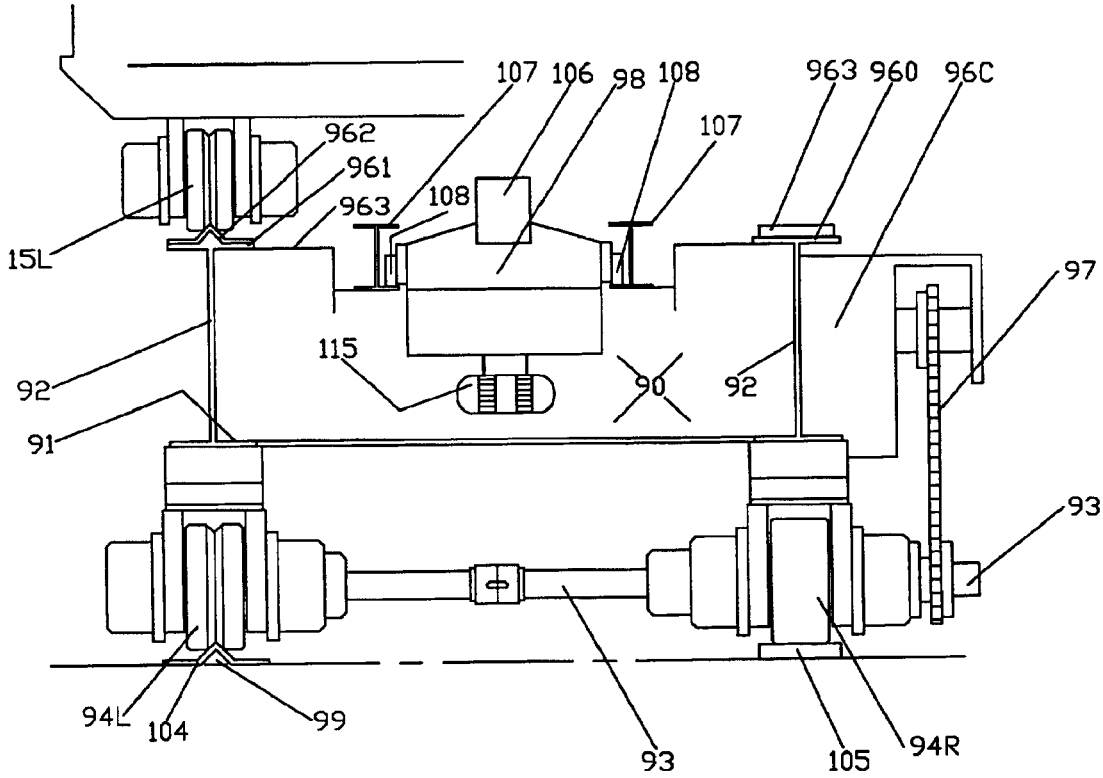
FIG. 10 depicts in partial top cutaway the power end of the transfer cart depicted in FIG. 9.

The transfer cart for mating with furnace 400 is depicted in FIG. 10 in partial cut away composite as viewed looking toward the front (entry) of furnace 400. The front guide side wheel 15L of furnace cart 300 (partially shown) rides on track 961 with guide 962 which is fixed to the upper surface of I beam 92 of frame 91 of transfer cart 90. Transfer cart wheels 94L and 94R ride on track 104L (having guide 99) and track 105, respectively. Power supply 96*c* drives chain 97 to rotate axel 93 to move transfer cart 90 toward or away from furnace 400. With transfer cart 90 at the furnace location in locked position, driven by chain 115 (FIG. 11) with distal turn pulley 118 (described in detail with reference to FIG. 11) push-pull tug 98 rolls on wheels 108 on inner surfaces of small I beams 107. I beams 107 provide structural support for transfer cart 90 as well as forming channel guides for wheels 108) pushing furnace carts 300 and 200 off transfer cart 90 and into furnace 400. Or, in the furnace unloading step, tug 98 is connected at connector 106 to tow bar 12 of furnace cart 200, and tug 98 withdraws furnace carts 200 and 300 from furnace 400.

Figure 11:
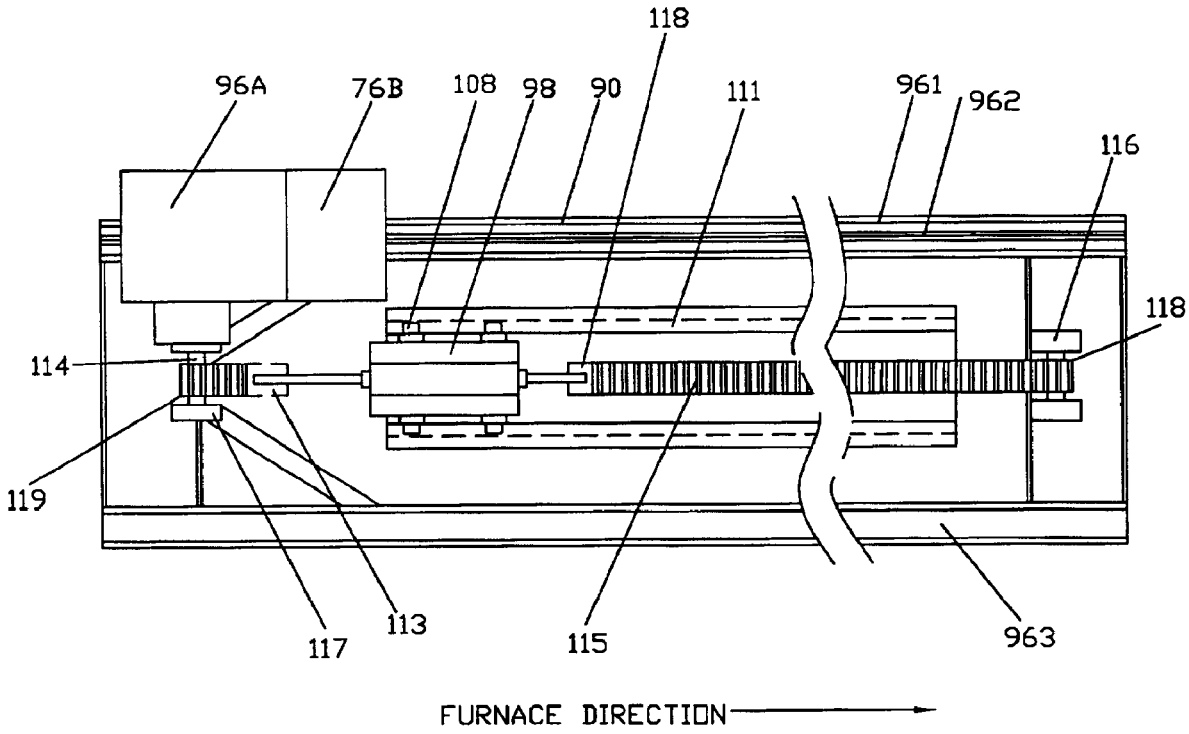
FIG. 11 depicts in partial top cutaway the transfer cart depicted in FIG. 9.

The chain drive function for moving push-pull tug 98 is illustrated more clearly in FIG. 11 illustrating in a top view cut away wherein power supply 96*a* which supplies rotating power to axel 114 to which drive pulley 119 is firmly attached. Power supply 96*a* is geared to provide selection as to whether movement of the upper part of chain 115, and therefore tug 98, is in the furnace direction, or in the direction away from the furnace. (Chain 115 is connected to tug 98 by connectors 113 and 118.) The placement in FIG. 11 of tug 98 shows the tug to be nearly as far from the furnace as it can be. This is the position in which tug 98 would ordinarily be as carts 200 and 300 (both on transfer cart 90) are being loaded with target material. During the loading furnace cart 200 would be connected to tug 98, and 300 would be connected to cart 200. Once carts 200 and 300 are fully loaded the transfer cart is moved into its mating position to the furnace, Then chain 115 would be moved by rotation of drive pulley 119 (clockwise as viewed from the bottom of FIG. 11) so tug 98 would push carts 200 and 300 in the direction of the furnace. On the top surface of I-beams 92 are shown track 961, having alignment guide 962, and track 963 on which wheels 15L and 15R, respectfully, would ride. Wheels 108 of tug 98 ride on inner surfaces 111 of smaller I-beams 107 until wheels 108 closest to the furnace move near to the furnace direction end of smaller I-beams 107. At that point tug 98 chain connection and chain end 112 approach but do not touch pulley 118. (See FIG. 12.) Of course, chain 115 with tug 98 forms a complete loop. A part of the bottom side of chain 115 (not to scale) which would reach from pulley 118 to pulley 119 is illustrated below in partial cut away side view, FIG. 12.

Figure 12:
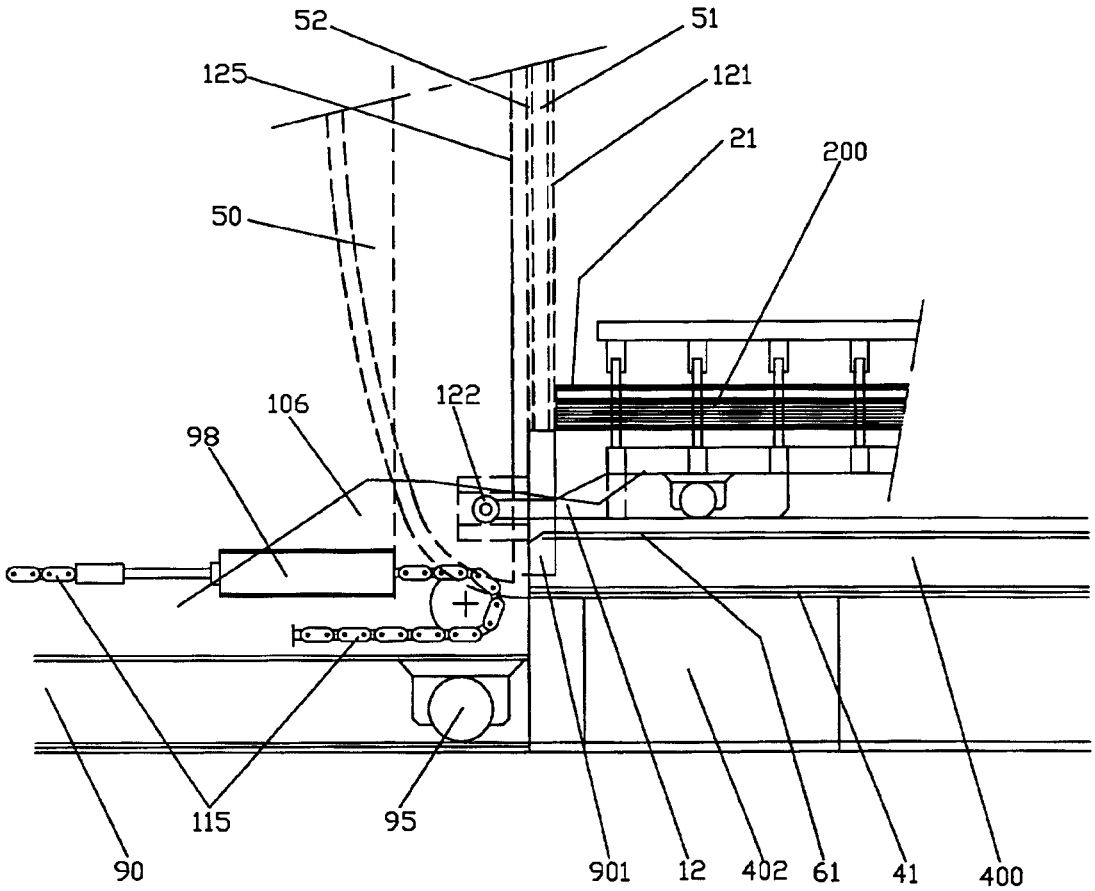
FIG. 12 depicts in partial cutaway, longitudinal cross section the correct longitudinal placement of the furnace cart in a furnace as depicted in FIG. 5A.

FIG. 12 illustrates the position of tug 98 after tug 98 has done its job of moving loaded carts 200 and 300 into furnace 400. (See also FIG. 5A.) Tug 98 would then be disconnected from cart 200 (disconnecting connection 106 at connection link 122, for example, a heavy-duty slot/bolt connection). Transfer cart 90 would then be moved away from furnace 400, so door 50 could be closed. (See FIGS. 5B, 5C and 13.) A partial cutaway of door 50 is shown in shadow as closed in FIG. 12 to provide a perspective on the importance of correct placement of cart 200. FIG. 13, again in partial cutaway illustrates furnace 400 mounted on furnace mount 402. Door 50 of furnace 400 is closed forming a vacuum seal with peripheral portion of door 50 mating with a corresponding lip on peripheral cylindrical surface of furnace 400 entrance. This is usually assured using an O-ring partially embedded proximate to the periphery of inner door surface 52. For a two door furnace as described above, the door at the opposing end of the furnace would desirably be very similar to door 50. Depending on furnace location it may be desirable to have the opposing door to be a substantial mirror image of door 50. The opposing door may not need a port comparable to port 56 of door 50. Chambers making up door 50 ordinarily are designed to communicate with one or more chambers in corresponding parts of the furnace. In furnace 400, for example, lower vacuum chamber lower part 401 communicates with door chamber 53. Chamber 131 which can be formed between outer door wall 130 and inner wall 132 can function as a door liquid coolant flow chamber to complement liquid coolant flow chamber 42.

Furnace cart 200 rests on tracks 61 and 63 (cutaway-cross section shows furnace cart wheel 15L on track 61). Furnace cart 200 is positioned so that the end of its insulation layer 21 will mate with the inner surface 121 of insulation layer 51 covering the selected part of surface 52 of closed furnace door 50. Insulation layer 51 also mates with the furnace face ends of heat shield 46 (FIG. 4) Tow bar 12 of furnace cart 200 protrudes into port 56 of furnace door 50.

From the forgoing, it can be understood that this invention provides a system that can safely load large or heavy target material into high temperature vacuum furnaces without major risk to furnace internal components, and furnace carts that open new opportunities for heat treating applications. Although various embodiments have been illustrated, this is for the purpose of describing, but not limiting the invention. Various modifications, which will become apparent to one skilled in the art, are within the scope of this invention described in the appended claims.

What is claimed is:

1. A furnace cart on which a target material may be placed for transfer into and out of a high temperature, deep vacuum furnace, said furnace cart comprising electrical resistance heating elements incorporated therein wherein said elements are adapted for releasable connection to said furnace electric supply, said cart further comprising: at least one frame below said elements, wheel mounting means secured to said frame for mounting wheels below said frame, wheels connected to said mounting means and supporting said cart, said frame further having an upward facing portion at least partially protected from heat by a heat reflective surface on said frame.

2. A furnace cart in accordance with claim 1 further including layer of deep vacuum and high temperature tolerant insulation which is located above said frame and below said heating elements.

3. A furnace cart in accordance with claim 2 further including mounting means for physically securing said heating elements to said frame but electrically separating said heating elements from said frame.

4. A furnace cart in accordance with claim 1 wherein said frame heat reflecting surface is a heat reflective substance selected from the group consisting of high temperature resistant heat reflective paint and reflective metal.

5. A furnace cart in accordance with claim 1 wherein said cart has a rear end in the direction of movement into the furnace and a forward end in the direction of movement out of the furnace and at least four wheels, a first rear wheel and a second rear wheel located near the rear end and a first forward wheel complementary to said first rear wheel and a second forward wheel complementary to said second rear wheel, both rear wheels being located near the rear end of said cart, each of said forward wheels located in lateral opposition to each other, and each of said rear wheels located in lateral opposition to each other, thereby providing a stable base for said cart frame.

6. A furnace cart in accordance with claim 5 wherein said furnace includes parallel tracks for supporting said furnace cart, at least one of said tracks having a support surface shaped for mating and guiding relationship with wheels, and wherein at least said one wheel of said furnace cart has a peripheral surface shaped for mated guiding relationship with said mating shaped track support surface for guiding the direction of travel of said cart along said track.

7. A furnace cart in accordance with claim 6 wherein said wheel having a peripheral surface shaped for mated guiding relationship with said mating shaped track support surface has at least one complimentary wheel also peripherally grooved for mated guiding relationship with the support surface of said mating track.

8. A furnace cart in accordance with claim 6 wherein the furnace cart has an even number of wheels higher than two, half of said wheels being longitudinally aligned with one of said parallel tracks and half of said wheels being longitudinally aligned with a second of said parallel tracks.

9. A furnace cart in accordance with claim 7 wherein said cart has at least two wheels laterally disposed to said peripherally grooved wheels, said laterally disposed wheels each having a linear peripheral cross section, and said cart is supported by two tracks, one track having a shaped support surface for mating with said peripherally grooved wheels, and one laterally opposed but parallel track having a fiat support surface for mating with said wheels having linear peripheral cross sections.

10. A furnace cart in accordance with claim 1 wherein said wheels have bearings capable of operating at temperatures of at least 500 degrees Fahrenheit and in deep vacuum.

11. A furnace cart in accordance with claim 1 wherein said frame has an upward facing surface, and said cart further includes a hearth, support posts of high strength, refractory material for supporting the hearth, and connecting means for physically securing said posts vertically to said upward facing surface but capable of inhibiting heat conduction from said posts to said frame.

12. A furnace cart in accordance with claim 11 wherein said connecting means comprises a ceramic material separating said support post from physical contact with said upper frame surface.

13. A furnace cart for use in a high temperature vacuum furnace, said furnace having a generally circular exterior cross section, and a depth dimension determining the interior length, a coolant chamber having an inner wall of a heat conducting metal and an outer wall, the outer wall generally defining said furnace circular cross section exterior, said coolant chamber providing a flow path through which coolant circulates during furnace operation, said furnace further including an interior including an upper portion having a work chamber of semicircular cross section and a lower portion having a semicircular cross section bottom, desirably painted black, that is also the inner wall of said coolant chamber, said inner wall of said lower portion having fixed thereto parallel tracks of a heat conducting metal for supporting said furnace cart with load, said lower portion further having two generally vertical sides each of which at its upper extremity meets a respective end of said semicircular cross section work chamber, said furnace cart comprising a layer of insulation, a transport structure below said layer of insulation, and above said layer of insulation heating elements connectable to said furnace electrical system, said furnace cart being capable of having significantly distinct but simultaneous temperature zones, a lower temperature zone and a higher temperature zone during furnace operation.

14. A furnace cart for use in a high temperature vacuum furnace in accordance with claim 13 wherein said lower portion of said furnace interior accommodates the lower temperature zone of said furnace cart, said semicircular work chamber includes an outer wall covered with high temperature deep vacuum tolerant insulation, said insulation terminating approximately at the ends of the semicircle, said work chamber further includes banks of interconnected heating elements inwardly spaced from said insulation, each of said banks approximating the semicircular shape of the semicircular wall of the work chamber, terminating at approximately the ends of the semicircle and said banks are disposed longitudinally along the length of said chamber, and said furnace cart insulation layer is positioned at a height and is sized to mate with the heat shield of the furnace.

15. A furnace cart for use in a high temperature vacuum furnace in accordance with claim 14 wherein said furnace cart comprises a frame having an upper and a lower surface, said insulation layer supported by but spaced above said upper frame surface and metallic wheels mounted for operation below said frame lower surface and spaced for mating with said parallel metallic tracks of said furnace parallel tracks.

16. A furnace cart for use in a high temperature vacuum furnace in accordance with claim 15 further including quench tubes which penetrate through said insulation layer.

17. A furnace cart capable during use of having significantly distinct but simultaneous temperature regions, a lower lower-temperature zone and an upper higher-temperature region, when used in a high temperature vacuum furnace comprising a bottom, an inner bottom, an outer surface, an inner surface, a work chamber, and capability of having two significantly distinct but simultaneous temperature regions, an upper higher-temperature capability region and a lower lower-temperature capability region said furnace upper region including an inner surface covered with high temperature deep vacuum tolerant insulation said upper region further including heating elements spaced toward the furnace interior from but in close proximity to said insulation and heating elements defining upper and lateral boundaries of said furnace work chamber, said furnace further including a lower portion having an uncovered inner surface, a bottom of a heat conducting metal, which is the furnace inner bottom, a coolant chamber having an inner wall, a portion of which forms the inner furnace bottom, and an outer wall, said coolant chamber providing a flow path through which coolant circulates during furnace operation, said inner furnace bottom having fixed thereto parallel tracks of a heat conducting metal spaced and dimensioned for supporting said furnace cart with load under treatment and during furnace load and unload procedures, said lower region further having two sides each of which at its upper extremity terminates where the insulation of said upper region begins, said cart comprising a horizontally disposed frame supported by wheels of heat conductive metal, a layer of high temperature deep vacuum tolerant insulation spaced from, above and parallel to said frame and having an upper surface slightly larger than said frame, quench tubes of low heat conductivity supported by and penetrating through said insulation layer, electrical resistant heating elements mounted from said frame but electrically not connected thereto, said elements spaced from, parallel to and above said region and a lower lower-temperature capability region said furnace upper region including an inner surface covered with high temperature deep vacuum tolerant insulation, support posts mounted on said frame with mounts that are of low heat conductivity, said posts protruding through said furnace cart insulation layer region and a lower lower-temperature capability region said furnace upper region including an inner surface covered with high temperature deep vacuum tolerant and long enough to extend above said heating elements, and a hearth mounted on said support posts.

18. A furnace cart capable of mating with and forming the lower part of the heat chamber of a high temperature vacuum furnace having in an upper part of said heat chamber an inner surface covered with high temperature deep vacuum tolerant insulation, the lowest level of which defines the low edge of said heat chamber, and electric resistance heating elements spaced toward the furnace interior from but in close proximity to said insulation, said furnace further comprising a lower portion including a furnace inner bottom of heat conducting metal, a coolant chamber having an inner wall, a portion of which forms said furnace inner bottom, and an outer wall, said coolant chamber providing a flow path through which coolant circulates during furnace operation, said inner furnace bottom having fixed thereto parallel tracks of a heat conducting metal spaced and dimensioned for supporting said furnace cart with load under treatment and during furnace load and unload procedures, said cart having the capability of assisting significantly distinct but simultaneous temperature furnace regions, an upper higher-temperature capability region and a lower lower-temperature capability region said furnace upper region including said heat chamber, said cart comprising a horizontally disposed frame supported by wheels of heat conductive metal mounted below said frame and spaced for mating with said tracks, a layer of high temperature deep vacuum tolerant insulation spaced from, above said frame and shaped, sized, and at a height that mates with the insulation at the low edge of said heat chamber, electrical resistant heating elements spaced from, parallel to and above said insulation mounted from said frame but electrically not connected thereto, posts mounted to said frame protruding through said insulation, horizontal support beams mounted on said posts and a hearth platform on said support beams.

* * * * *